United States Patent [19]

Takahashi et al.

[11] 4,233,919

[45] Nov. 18, 1980

[54] SEWING MACHINE PROTECTION APPARATUS

[75] Inventors: Tadashi Takahashi; Shigeki Morinaga, both of Hitachi, Japan

[73] Assignee: Hitachi, Ltd., Japan

[21] Appl. No.: 921,952

[22] Filed: Jul. 5, 1978

[30] Foreign Application Priority Data

Jul. 13, 1977 [JP] Japan ..... 52-82874
Sep. 2, 1977 [JP] Japan ..... 52-104887

[51] Int. Cl.[3] ..... D05B 69/22; D05B 69/36; D05B 19/00

[52] U.S. Cl. ..... 112/277; 112/275; 192/129 A

[58] Field of Search ..... 112/121.11, 275, 277, 112/300, 220; 192/129 A; 318/62, 272

[56] References Cited

U.S. PATENT DOCUMENTS

| | | | |
|---|---|---|---|
| 3,573,581 | 4/1971 | Dutko | 112/275 X |
| 3,827,040 | 7/1974 | Simmons | 192/129 A X |
| 3,843,883 | 10/1974 | De Vita et al. | 112/273 X |
| 4,038,931 | 8/1977 | Kosrow et al. | 112/277 |
| 4,104,978 | 8/1978 | Takahashi et al. | 112/277 |

FOREIGN PATENT DOCUMENTS

| | | | |
|---|---|---|---|
| 53-2801456 | 8/1978 | Japan | 112/275 |

*Primary Examiner*—Werner H. Schroeder
*Assistant Examiner*—Andrew M. Falik
*Attorney, Agent, or Firm*—Craig and Antonelli

[57] ABSTRACT

An electric motor-driven sewing machine which includes a drive mechanism for driving the machine by an electric motor, a mechanism for stopping operation of the machine by a brake, an automatic thread trimmer mechanism, a wiper mechanism for removing the trimmed thread, command switches for providing command signals to the sewing machine and control circuit means for controlling the various operations of the sewing machine in accordance with electrical signals. Apparatus is provided for detecting an abnormal state in which input signals which are not to take place simultaneously occur simultaneously, and to invalidate the operations of the various mechanisms of the sewing machine to protect the user from danger due to erroneous operations of the sewing machine.

7 Claims, 14 Drawing Figures

SEWING MACHINE PROTECTION APPARATUS

BACKGROUND OF THE INVENTION

1. Field of the Invention

The present invention relates to a protection apparatus for safety operation of an automated electric motor-driven sewing machine such as industrial sewing machine.

2. Description of the Prior Art

For the electric motor-driven sewing machine particularly for use on the industrial or commercial base, there have been hitherto known a method of driving the sewing machine through a clutch mechanism including an electromagnetic clutch and brake (e.g. refer to U.S. Pat. No. 3,761,790) as well as a method of directly transmitting power to the sewing machine from a DC motor. However, those methods are basically similar with respect to controlling the sewing machine.

In the modern sophisticated industrial sewing machines, many complicated control procedures are adopted. For a better understanding of the invention, a general description will be made of a control apparatus for a sewing machine which is driven through an electromagnetic clutch and provided with an automatic thread clipping or trimming mechanism as well as an automatic stopping mechanism for stopping the operation of the sewing machine at an upper (top) and a lower (bottom) position of the sewing needle.

In general, command signals for controlling the operation of the sewing machine are produced by a foot pedal. More specifically, when the foot pedal is pressed down in the forward direction, a leading command switch (LSW) is turned on, while a trailing command switch (TSW) is turned on upon treading of the foot pedal in the backward direction. In the neutral position of the foot pedal, both of the leading and trailing command switches are in the off-state. Additionally, an up position detector (UD) for detecting the upper position of the sewing needle is provided in combination with a down position detector (DD) for detecting the lower position of the sewing needle for producing the respective signals. A tachometer generator (TG) is also provided to produce a signal representative of the actual operation speed of the sewing machine, which signal is then supplied to a speed controller circuit to be compared with a reference command signal, whereby the sewing machine is operated at a preselected constant speed under the control of the speed controller circuit.

The output signal from the speed controller circuit includes a first control signal applied to a coil of the clutch mechanism and a second control signal applied to a coil of the electromagnetic brake. Both of these control signals are made valid by a speed control enabling signal produced by a sequence control unit. In other words, only when the speed control enabling signal is present, the speed control is validated, thereby to drive the sewing machine at the selected constant speed.

The sequence control unit operates in general in the following manner:

In the first place, when the leading command switch is turned on by treading down upon the foot pedal forwardly, the speed control enabling signal is produced, whereby the clutch coil and the brake coil are energized in dependence on the output signals from the speed controller circuit to drive the sewing machine at a constant speed. When the foot pedal is actuated to the neutral position, the leading command switch is turned off, resulting in disappearance of the speed control signal. However, if the down position detector produces no lower needle position signal at that time, the speed control enabling signal is produced to rotate the sewing machine until the needle reaches the lower position, whereupon the speed control enabling signal is invalidated by the output signal from the down position detector. At the same time, the brake coil is energized for a predetermined time duration, thereby to stop the sewing needle at the lower position. When the trailing command switch is turned on by pressing down the foot pedal backwardly, the automatic thread trimmer coil is energized to actuate the automatic thread clipping or trimming mechanism. At that time point, no signal is produced from the up position detector. Thus, the speed control enabling signal can be generated to drive the sewing machine.

Upon detection of the upper needle position through the associated up position detector, the automatic thread trimmer coil is deenergized. Simultaneously, the brake coil and the wiper coil for the wiper mechanism to remove or clear the trimmed thread are energized for a predetermined time, thereby to stop the sewing machine at the upper needle position to allow the trimmed thread to be wiped away.

In the electric motor-driven sewing machine, the operations of which are controlled in the manner described above, adequate measures must be taken for the safety and security of the machine operation in view of the fact that the needle which may possibly injure the user is handled in addition to the fact that one sewing machine may be manipulated by a plurality of non-specified workers.

It is to be mentioned in conjunction with the foregoing that both of the up and down needle position detectors UD and DD are mounted on the main body of the sewing machine, while the leading and trailing command switches are mounted at the positions capable of being interlocked with the foot pedal. Thus, the connections of these components to the other circuit and in particular to the speed controller circuit have to be realized by using lead wires. When short-circuit or breakage of these leadwires should occur, the output signals from both of the up and down position detectors or the output signals from both of the leading and the trailing switches will be produced simultaneously, as the result of which the automatic thread trimmer mechanism and the thread wiper mechanism may be erroneously actuated notwithstanding of the fact that the needle is located at the lower position, thereby involving breakage of the needle, injury to the sewing machine and the burning of the drive motor. These undesirable phenomena may be caused by noises.

SUMMARY OF THE INVENTION

An object of the invention is to provide a protection apparatus for safety operation of a sewing machine which avoids the disadvantage of the hitherto known apparatus and is capable of preventing positively the sewing machine from erroneous operations as brought about by the breakage or short-circuit of the lead wires, noise, or the like causes, thereby to protect the user from any possible dangers caused by such erroneous operation.

In view of the above and other objects which become apparent from the following description, there is provided according to an aspect of the invention a protection apparatus for safety operation of an electric motor-driven sewing machine which includes a drive mechanism for driving the machine by an electric motor, a mechanism for stopping operation of the machine by a brake, an automatic thread trimmer mechanism, a wiper mechanism for removing the trimmed thread, command switches for providing command signals to the sewing machine and control circuit means for controlling the various operations of the sewing machine in accordance with electrical signals, wherein means are provided for detecting an abnormal state in which input signals which are not inherently to take place simultaneously occur simultaneously, thereby to invalidate the operations of the various mechanisms of the sewing machine.

DETAILED DESCRIPTION OF THE PREFERRED EMBODIMENTS

Now, the invention will be described below in conjunction with one embodiment thereof with reference to the accompanying drawings.

Figure 1:
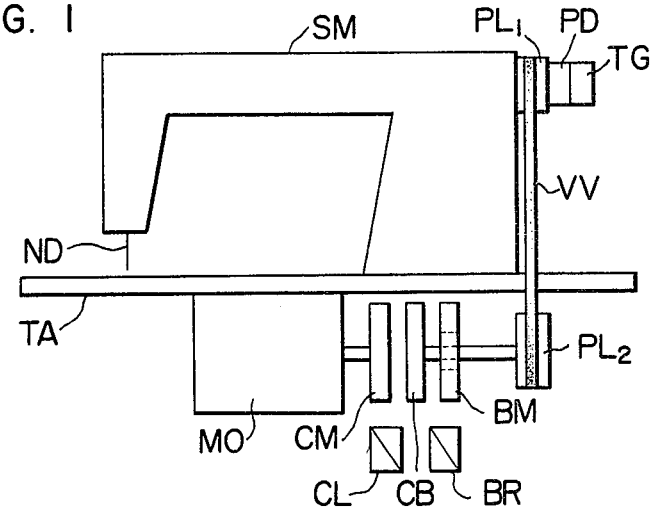
FIG. 1 is a schematic diagram showing a general arrangement of an industrial sewing machine provided with an electromagnetic clutch-motor driving system.

FIG. 1 is a schematic diagram showing a general arrangement of an industrial sewing machine to which the invention can be applied. In the figure, reference symbol SM denotes a main body of the sewing machine adapted to be driven by an electric motor through a belt VV, a pulley $PL_1$ and a pulley $PL_2$ which is directly coupled to a clutch plate CB. The sewing machine SM is further provided with a needle position detecting device PD for detecting upper and lower positions of a sewing needle ND as well as a tachometer generator TG.

Disposed at opposite sides of the clutch plate CB are a friction brake plate BM and a frictional clutch plate CM which is directly coupled to a drive motor MO. When a clutch coil CL is electrically energized, the clutch plate CB is pressed against the frictional clutch plate CM, whereby the driving power of the motor MO is transmitted to the sewing machine mechanism SM. On the other hand, upon energization of a brake coil BR, the clutch plate CB is pressed against the friction brake plate BM thereby to stop the operation of the sewing machine. Reference symbol TA denotes a work table.

Figure 2:
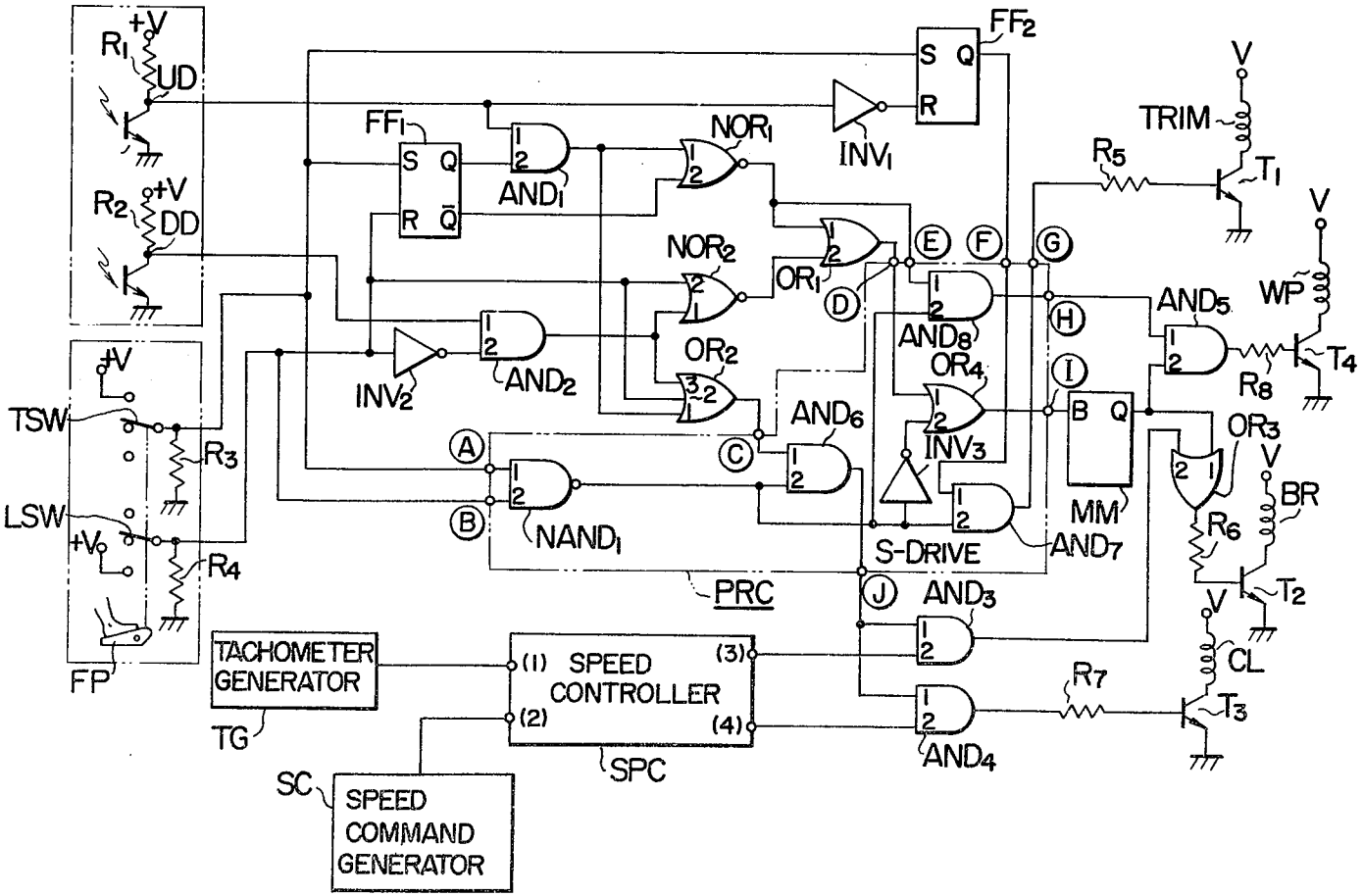
FIG. 2 is a circuit diagram of a control circuit according to one embodiment of the invention.

Referring to FIG. 2 which is a circuit diagram of a control circuit according to an embodiment of the invention for safety operation of the sewing machine of the general construction described above. The needle position detecting device PD is constituted by an up position detector UD and a down position detector DD which are adapted to produce output signals of a level L in response to the presence of the sewing needle ND at the upper and the lower positions, respectively. Leading and trailing command switches LSW and TSW for commanding operations of the sewing machine SM are interlocked with a food pedal FP in such a manner that the pressing or treading-down of the food pedal FP in the forward direction by the tip toe of a foot will turn on the switch LSW, while the backward treading of the foot pedal FP will cause the trailing switch TSW to be turned on. These switches LSW and TSW produce output signals of a high level H when actuated. In a neutral position of the food peal FP at which no foot force is applied, both the switches LSW and TSW remain in the off-state producing the low level outputs L, respectively.

A speed controller circuit SPC is provided which has a first input (1) connected to the tachometer generator TG and a second input (2) connected to a speed command unit SC. The speed command unit SC is arranged to produce an output signal such as the one graphically illustrated in FIG. 3*a* by way of example. To this end, this unit SC may include a variable resistor or potentiometer $VR_1$ having one end connected to a DC power source +V and the other end grounded through a Zener diode $ZD_1$. A slidable wiper arm a of the potentiometer $VR_1$ is interlocked with the food pedal FP so that the arm a is caused to move slidably along the resistor $VR_1$ in dependence on the tread depth or stroke of the foot pedal FP.

Figure 3A:
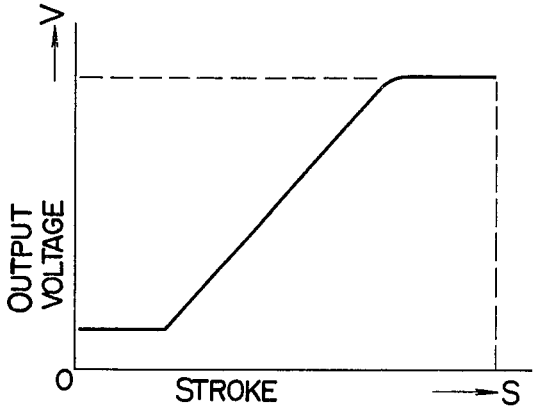
FIG. 3*a* is a graph for illustrating a stroke-voltage characteristic of a speed command device SC employed in the control circuit of FIG. 2.
Figure 3B:
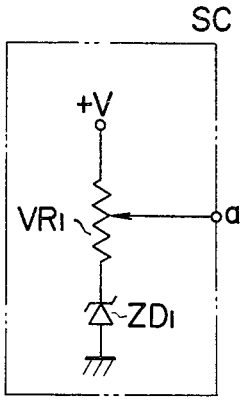
FIG. 3*b* is a circuit diagram showing an exemplary embodiment of the speed command device SC employed in the control circuit of FIG. 2.
Figure 3C:
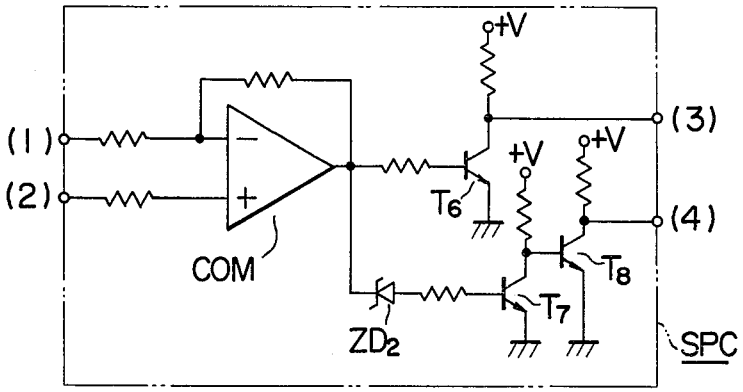
FIG. 3*c* is a circuit diagram showing an exemplary embodiment of a speed controller SPC employed in the control circuit of FIG. 2.

On the other hand, the speed controller circuit SPC may be implemented in such arrangement as shown in FIG. 3*c*. The outputs from the tachiometer generator TG and the speed command unit SC are supplied, respectively, to the input terminals (1) and (2) and hence coupled to a comparator COM through respective resistors. The output of the comparator COM is connected to a switching transistor $T_6$. When the output signal from the tachiometer generator TG is at a low level relative to the output signal (command signal) produced from the speed command unit SC, the transistor $T_6$ is turned on, which results in a potential of the level L at an output terminal (3) providing a control signal for the brake coil BR. On the other hand, the output of the comparator COM is connected to the cascaded transistors $T_7$ and $T_8$ through a Zener diode $ZD_2$. When the output from the comparator COM which causes the transistor $T_6$ to be turned on is set higher than a Zener voltage $V_{Z2}$ of the Zener diode $ZD_2$, then the transistor $T_7$ is turned on, while the transistor $T_8$ is turned off, which in turn results in a potential of the high level H at an output terminal (4) providing a control signal to the clutch coil CL.

Referring to FIG. 2, the output terminal (3) of the speed controller circuit SPC is connected to an input 2 of an AND gate circuit $AND_3$, while the output terminal (4) is connected to the input 2 of an AND gate circuit $AND_4$.

The output signal from the up position detector UD is applied to a reset terminal of a flip-flop $FF_2$ through an inverter circuit $INV_1$ and at the same time to an input 1 of an AND gate circuit $AND_1$. The output from the down position detector DD is coupled to an input 1 of an AND gate circuit $AND_2$. The output signal from the leading command switch LSW is coupled to a reset terminal R of a flip-flop $FF_1$, an input 2 of NOR gate circuit $NOR_2$, an input 2 of NAND gate circuit $NAND_1$ and an input 2 of OR gate circuit $OR_2$, respectively, and additionally to an input 2 of AND gate circuit $AND_2$ through an inverter $INV_2$. On the other hand, the output signal from the trailing command switch TSW is coupled to set terminals S of the flip-flops $FF_1$ and $FF_2$ and to an input 1 of NAND gate circuit $NAND_1$, respectively. The flip-flop $FF_2$ has an output Q which is coupled to an input 1 of AND gate circuit $AND_7$ having a second input 2 connected to an input of an inverter circuit $INV_3$ and to the output terminal of NAND gate circuit $NAND_1$. The output from the inverter $INV_3$ is coupled to an input 2 of OR gate circuit $OR_4$.

The output from the AND gate circuit $AND_7$ is connected to the base of a transistor $T_1$ having a collector connected to one end of a coil TRIM of an automatic thread clipper or trimmer mechanism which coil has the other end connected to the potential source V. The output Q of the flip-flop $FF_1$ is connected to an input 2 of AND gate circuit $AND_1$, while the complementary output $\overline{Q}$ thereof is connected to an input 2 of the NOR gate circuit $NOR_1$. The output from the AND gate circuit $AND_1$ is connected to an input 1 of the NOR gate circuit $NOR_1$ having an output connected to an input 1 of OR gate circuit $OR_1$ and to an input 1 of the AND gate circuit $AND_8$. The output of the OR gate circuit $OR_2$ is connected to an input 1 of the AND gate circuit $AND_6$ which has the output connected to the input terminals 1 of the AND gate circuits $AND_3$ and $AND_4$, respectively. The output from the NOR gate circuit $NOR_2$ is coupled to an input 2 of the OR gate circuit $OR_1$ which has the output connected to an input 1 of the OR gate circuit $OR_4$, the output of which in turn is connected to an input terminal B of a mono-stable multivibrator MM having an output terminal Q connected to an input 2 of the AND gate circuit $AND_5$ and an input 1 of an OR gate circuit $OR_3$. The OR gate circuit $OR_3$ is provided with a second input 2 connected to the output of the AND gate circuit $AND_3$. The input terminal 1 of the AND gate circuit $AND_5$ is connected to the output of the AND gate circuit $AND_8$, while the output of the former is connected to the base of a transistor $T_4$ through a resistor $R_8$. The output of the OR gate circuit $OR_3$ is connected to the base of a transistor $T_2$ through a resistor $R_6$. The output of the AND gate circuit $AND_4$ is connected to the base of a transistor $T_3$ through a resistor $R_7$. The transistors $T_4$, $T_3$ and $T_2$ have the respective collectors connected to the power source V through a thread clearing or wiper coil WP, the brake coil BR and the clutch coil CL, respectively.

With the arrangement described above, when the leading command switch LSW is turned on, the output from the OR gate circuit $OR_2$ will be at a high level H as shown in FIG. 3*a*. If the trailing command switch TSW is off at that time, the output from the NAND gate circuit $NAND_1$ will be at the high level H and hence the output from the AND gate circuit $AND_6$ which is referred to as S-DRIVE signal will be at the high level H. Consequently, the outputs (3) and (4) of the speed controller circuit SPC will become validated, whereby the clutch coil CL as well as the brake coil BR are controlled by the output signals from the speed controller circuit SPC, thereby to maintain the operation speed of the sewing machine SM to be constant, at which speed the machine SM can continue to be driven.

On the other hand, if the trailing command switch TSW is faulty and the output signal thereof is at the high level H when the leading command switch LSW is actuated, the input to the NAND gate circuit $NAND_1$ will also be at the high level, producing output of the low level L. Consequently, outputs from the AND gate circuits $AND_6$, $AND_7$ and $AND_8$ will be at the low level L with the result that the outputs from the AND gate circuits $AND_4$ and $AND_5$ will be also at the low level L. Then, the transistors $T_1$, $T_3$ and $T_4$ will remain non-conductive. Under the circumstances, neither the clutch coil CL nor the automatic thread trimmer coil TRIM nor the thread wiper coil WP will be energized.

Additionally, since the output from the inverter $INV_3$ and hence the output from the OR gate circuit $OR_4$ will be at the high level H, the mono-stable multivibrator MM will be triggered, whereby the brake coil BR is energized for a predetermined time duration determined by the monostable multivibrator MM thereby to stop the operation of the sewing machine SM.

Next, it is assumed that the trailing command switch TSW is in a normal operative state and produces the low level signal L. When the trailing command switch LSW is turned off during rotation of the sewing machine, the signal S-DRIVE which validates the speed controller circuit SPC will be cut off. However, if the output signal from the down position detector DD is absent at that time, the output from the AND gate circuit $AND_2$ will be at the high level H, resulting in the high level outputs also from the OR gate circuit $OR_2$ and the AND gate circuit $AND_6$. Thus, the signal S-DRIVE is maintained at the high level, whereby the sewing machine SM continues to be operated. When the needle has reached the lower position, the output from the down position detector DD will then be at the low level L, as the result of which the output from the AND gate circuit $AND_2$ will be at the low level to invalidate the signal S-DRIVE. Simultaneously, since the output signal from the NOR gate circuit $NOR_2$ together with the outputs from the OR gate circuit $OR_1$ and $OR_4$ will become a high level H, the mono-stable multivibrator MM is turned on for the predetermined time thereby to energize the brake coil BR. Thus, the sewing machine SM is stopped with the needle located at the lower position.

On the assumption that the leading command switch LSW is in the normal state without any failure, the turning-on of the trailing command switch TSW will result in the high level Q-output from the flip-flop $FF_2$, causing the output from the AND gate circuit $AND_7$ to be at the high level H. Thus, the automatic thread clipper or trimmer coil TRIM is energized. At the same time, since the Q-output from the flip-flop $FF_1$ will be at the high level H, the outputs from the gate circuits $AND_1$, $OR_2$ and $AND_6$ become a high level H thereby to validate the speed controller circuit SPC. The sewing machine SM is then driven. After a half revolution of the sewing machine, the needle will reach the upper position, which results in the low level L output from the up position detector UD to cause the output from the AND gate circuit $AND_1$ as well as the outputs from the gate circuits $OR_2$ and $AND_6$ to be at the low level L. Consequently, the signal S-DRIVE is interrupted to stop operation of the sewing machine SM. At the same time, since the output from NOR gate circuit $NOR_1$ is at the high level H with the outputs from the gate circuits $OR_1$ and $OR_4$ taking also the high level H, the brake is actuated for the predetermined duration determined by the multivibrator MM to stop the machine SM at the position where the needle is located at the upper position. Simultaneously, the flip-flop $FF_2$ is reset with the Q-output thereof taking the low level L, whereby the automatic thread clipper or trimmer coil TRIM is deenergized. Additionally, output signals from the AND gate circuit $AND_1$ and the flip-flop $FF_1$ become the low level L, resulting in the high level outputs from the gate circuits $NOR_1$ and $AND_8$. Thus, the thread wiper coil WP is energized in synchronism with the brake coil BR, thereby to remove or clear the trimmed thread.

Assuming that the leading command switch LSW is faulty to produce the high level output signal, the turning-on of the trailing command switch TSW will instantaneously cause the output from the gate $NAND_1$ to be at the low level L thereby to disenable the AND gates $AND_6$, $AND_7$ and $AND_8$ with the output from the gate $OR_4$ at the high level H. Consequently, all of the automatic thread trimmer coil TRIM, the thread wiper coil WP and the clutch coil CL are inhibited from energization, while the brake coil BR is energized for the predetermined thereby to stop the sewing machine SM in a fool-proof manner. Thus, there will never arise any danger such as breakage of the needle ND.

The above description has been made in conjunction with the case in which the leading and the trailing command switches LSW and TSW are faulty. However, the safety operation control described above will be effective in the case where the fault is caused for other reasons such as breakage of electric lead wires, short-circuit, noise or the like.

It will be thus appreciated that the protection apparatus according to the invention can safely exclude the erroneous operation of the sewing machine which otherwise may occur due to failure of the leading command switch and the trailing command switch both of which serve as the command switches for controlling the machine operations and due to breakage of electrical conductors, noise or the like and thus protects the user from danger such as breakage of the needle.

Figure 4:
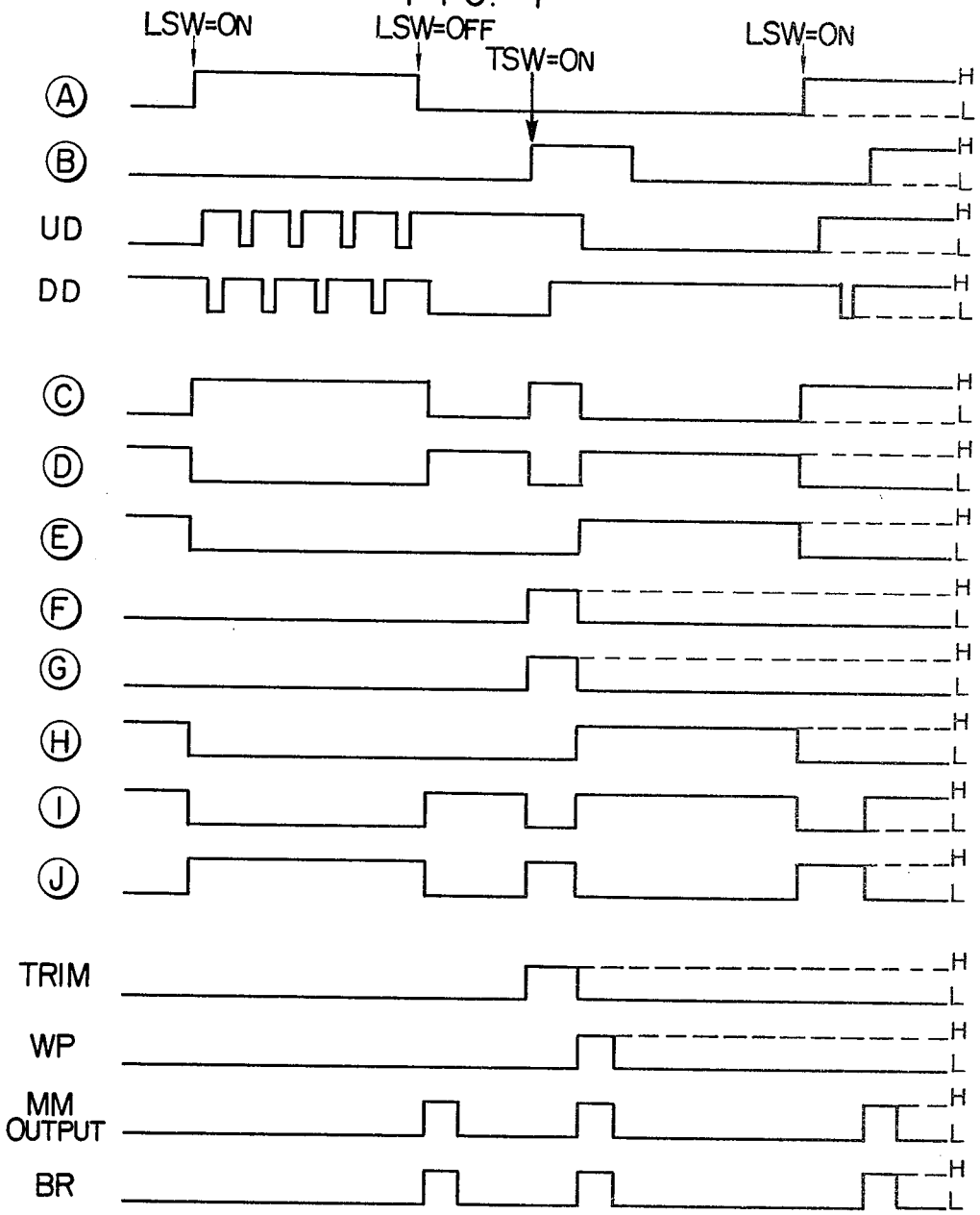
FIG. 4 is a time chart for illustrating waveforms of output signals developing at corresponding circuit points shown in FIG. 2.

The main feature of the present invention is realized particularly in the protection circuit PRC indicated by a broken line block in FIG. 2. Another embodiment of such protection circuit PRC will be now described by referring to FIG. 5 in combination with FIG. 4 which is a time chart showing waveforms of various signals at various circuit points shown in FIGS. 2 and 5. In FIG. 4, signal waveforms Ⓐ to Ⓙ are those produced at the circuit points denoted by the same reference characters in FIG. 2.

In the case of the protection circuit shown in FIG. 2, the circuit arrangement is made such that the apparatus is restored to the normal state immediately after the fault of the leading command or the trailing command switch LSW or TSW has been removed. In the protection circuit shown in FIG. 5, alarm means are provided for signaling the user of a fault or abnormality condition in combination with manual operation restoring mean for inhibiting the instantaneous automatic initiation of operation of the sewing machine when the cause of fault has been removed, thereby to protect more safely the operator or user.

Figure 5:
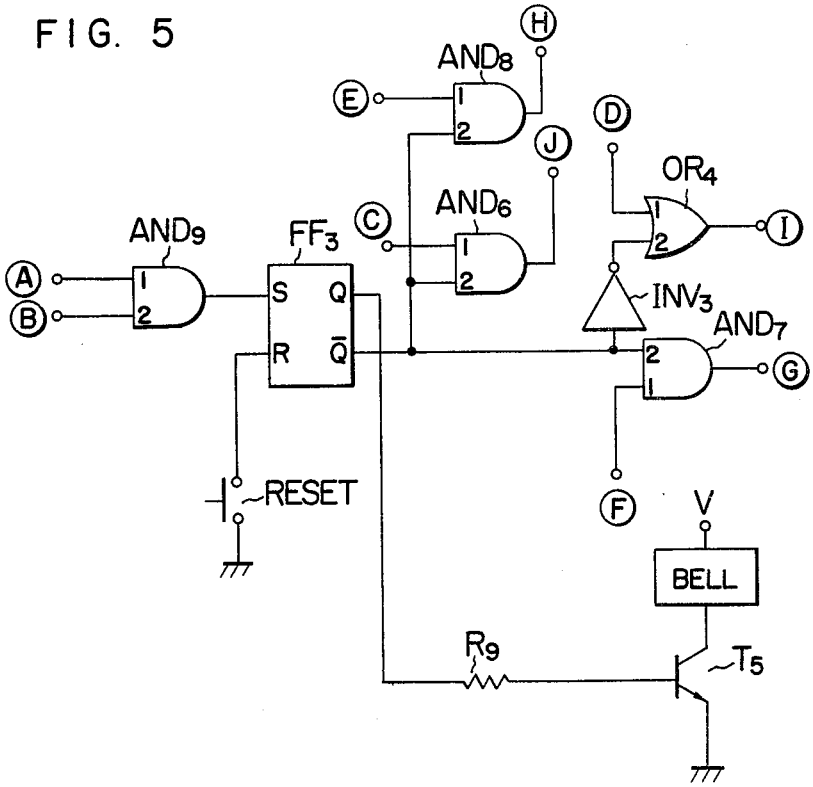
FIG. 5 is a circuit diagram showing a modification of the control circuit of FIG. 2.

Referring to FIG. 5, if the leading command switch LSW and the trailing command switch TSW should be turned on simultaneously, the output from the gate $AND_9$ will becomes a high level H, whereby the flip-flop $FF_3$ is set to maintain the $\overline{Q}$-output at a low level L. Consequently, output signals from the gates $AND_6$, $AND_7$ and $AND_8$ will remain at the low level L, resulting in that the coils for the automatic thread trimmer mechanism, the thread wiper mechanism and the clutch remain in the deenergized state. At the same time, because of the high level Q-output from the flip-flop $FF_3$, the transistor $T_5$ is turned on, thereby to actuate an alarm device BELL for signalling the prevailing abnormal states of the command switches LSW and TSW.

The restoration of the machine operation is effected by applying a reset signal to the reset terminal R of the flip-flop $FF_3$ by pushing a reset button switch RESET or through any suitable means.

Figure 6:
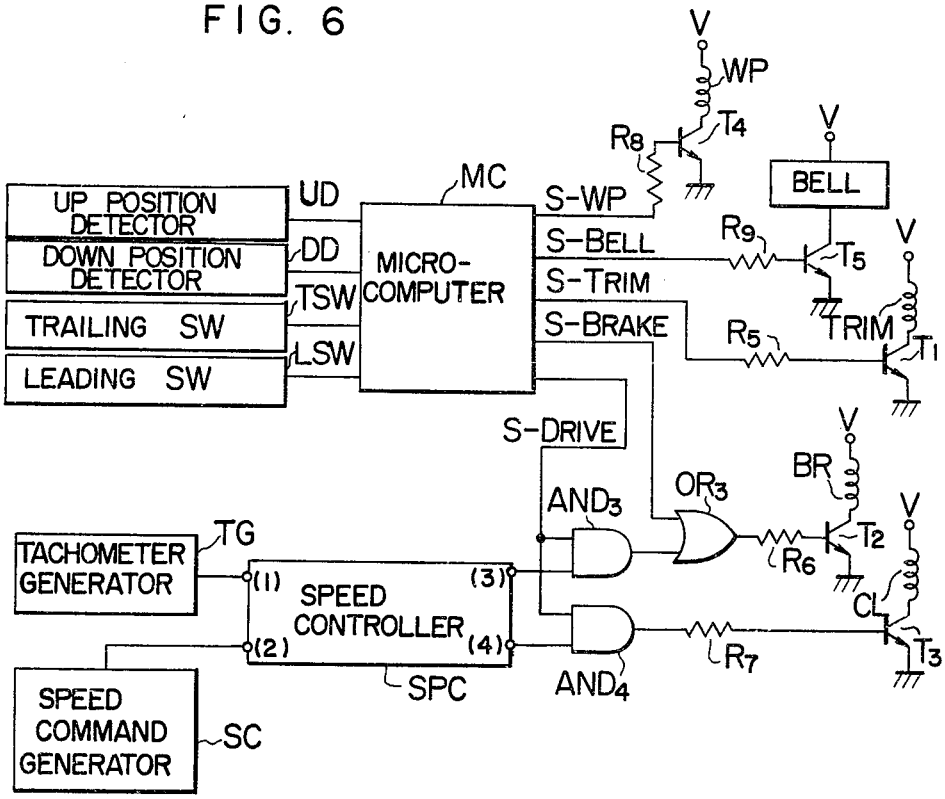
FIG. 6 is a circuit diagram showing another modification of the control circuit of FIG. 2, which is provided with a micro-computer.

FIG. 6 shows another embodiment of the protection circuit according to the invention. In this figure, the same reference symbols as those used in FIG. 5 represent the same or corresponding function elements. In the case of the embodiment shown in FIG. 6, a micro-computer MC (hereinafter referred to simply as computer or MC) is employed as a control circuit and may include a central processor CP, a data memory or RAM (random access memory), a program memory of ROM (read-only memory) or the like implemented in multi-chips or in a single chip. For the inputs to the computer MC, state information of the command switches LSW and TSW as well as output signal from the needle position detectors UD and DD may be utilized as is in the case of the protection circuit shown in FIG. 2. The output signals from MC include the signal S-DRIVE for validating or enabling the outputs (2) and (3) of the speed controller circuit SPC, a brake signal S-BRAKE of a predetermined duration, an automatic thread trimming signal S-TRIM, a thread clearing wiper signal S-WP and an alarm enabling signal S-BELL for actuating the alarming device BELL.

Figure 7:
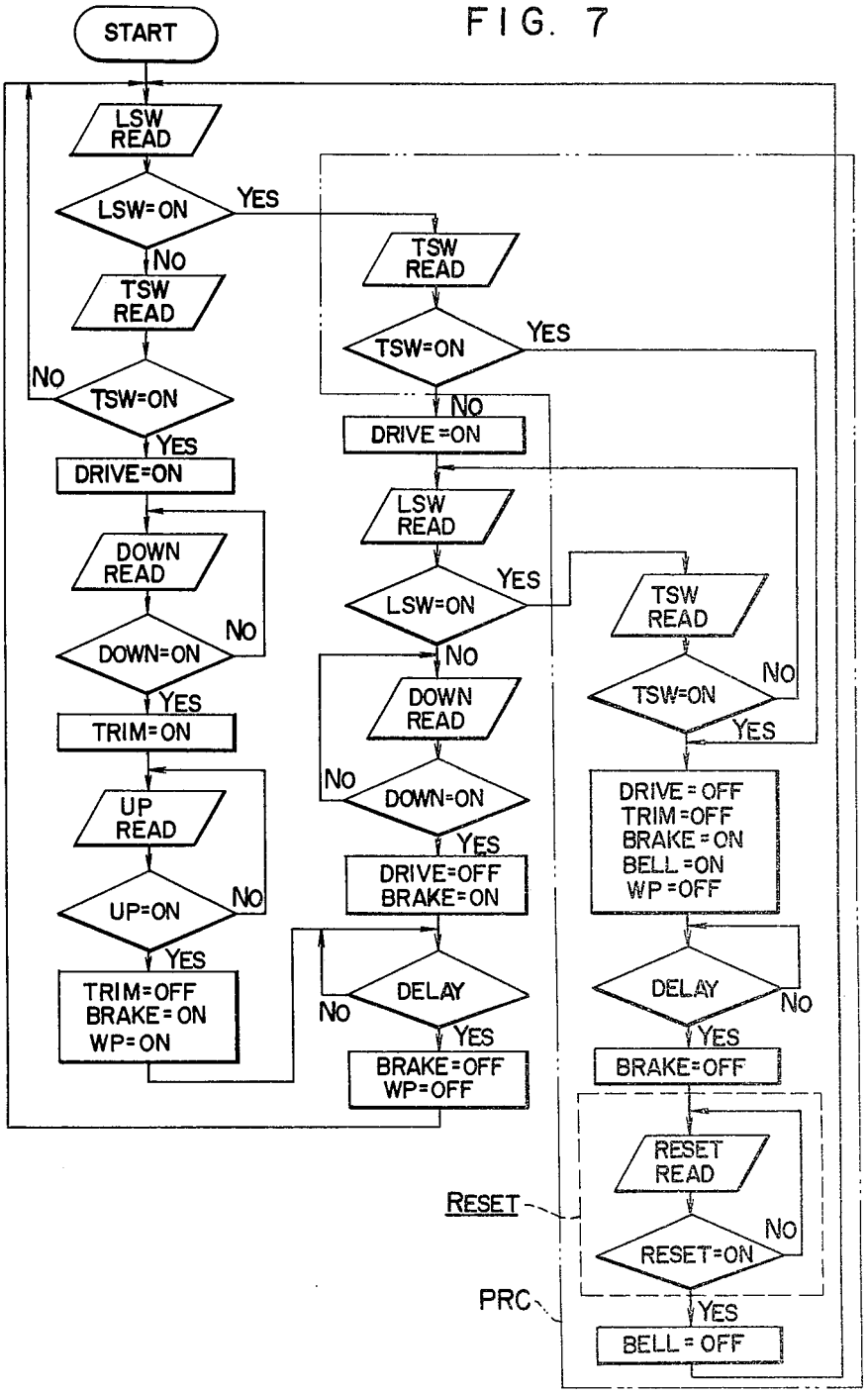
FIG. 7 is a flow chart illustrating operation of the control circuit of FIG. 2.

The program of the micro-computer MC is illustrated in a flow chart shown in FIG. 7.

Referring to FIG. 7, the operation of the protection circuit of FIG. 6 will be described. It is first assumed that both of the leading command switch LSW and the trailing command switch TSW are in the normal state. The micro-computer MC is initialized at the block START. At the block LSW READ, the state of the switch LSW is fetched as the input information. At the succeeding decision block LSW=ON, the state information of the switch LSW is checked, and if the switch LSW is "on", the program proceeds to a block TSW READ at which the state information of the switch TSW is fetched as the input to the computer CM. Since the switch TSW is closed from the above assumption, the result of decision at the block TSW=ON is negative. Thus, the signal S-DRIVE is produced at the step DRIVE=ON which validates the speed control signal thereby to drive the sewing machine.

At the next step LSW READ, the state information of the switch LSW is again fetched as the input in order to check that the switch LSW is turned off at the decision block LSW=ON. If the result in negative, i.e. the switch LSW is turned off, the program proceeds to the block DOWN READ where the output signal from the down position detector DD is fetched in the computer CM in order to check that the needle reaches the lower position at the decision block DOWN=ON. This subroutine is repeated until the needle has reached the low position, upon which the signal S-DRIVE is interrupted and the signal S-BRAKE is generated at the block DRIVE=OFF & BRAKE ON. After the elapse of the braking duration as decided at the block DELAY, the signal S-BRAKE is cleared. Then, the program routine returns to the first block LSW READ to check the state of the switch LSW.

When the switch TSW is turned on with the switch LSW being off, the state information of the switch TSW is fetched at the block TSW READ and checked at the decision block TSW=ON. At this time, since the switch TSW is assumed to be closed, the decision is affirmative and thus the signal DRIVE is produced at the step DRIVE=ON to drive the sewing machine. The next step is to check the lower position of the needle. If the needle is detected as located at the lower position, the result of the decision block DOWN=ON is affirmative, as the result of which the automatic thread trimming signal TRIM is validated at the block TRIM=ON. Subsequently, the sewing machine is driven for a half revolution. Then, the decision at the block UP=ON will be affirmative and the automatic thread trimming signal S-TRIM is cleared, while the brake signal S-BRAKE as well as the thread wiper signal S-WP are made valid.

After the elapse of a preset time interval, the signals S-BRAKE and S-WP are made invalid. The program returns to the first block to check the switch LSW.

Next, it is assumed that the switch TSW is faulty and remains continuously in the on-state. The state of the switch LSW is checked and, if the switch is detected in the on-state, the answer of the decision block LSW=ON is affirmative. Then, at the step TSW READ, the state information of the switch TSW is fetched into the computer MC. From the above assumption, the result of the decision block TSW=ON will be affirmative. Then, the program is branched to the block at which the signals S-DRIVE, S-TRIM and S-WP are made invalid, while the brake signal S-BRAKE and the alarm signal S-BELL are validated. The signal S-BRAKE is made invalid after elapse of a preset time duration. This state is held as it is until the reset signal has been applied at the step RESET.

In this manner, the protection circuit shown in FIGS. 6 and 7 will operate so as to assure a safety operation by excluding danger such as break of needle due to the fault of the command switches, lead wires, noise or the like in the quite similar manner as the circuits shown in FIGS. 2 and 5.

Figure 8:
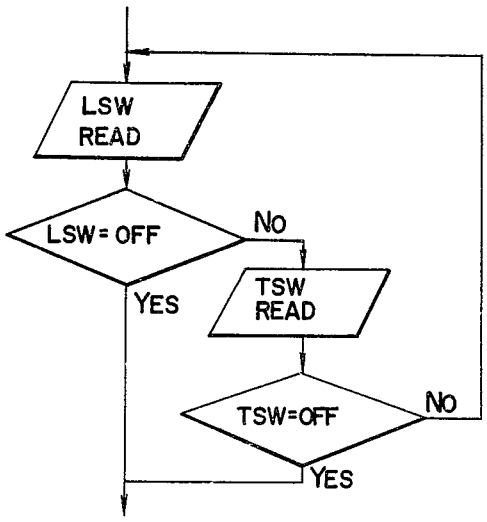
FIG. 8 is a major part of flow chart illustrating a modification of a subroutine executed by the control circuit of FIG. 6.

FIG. 8 shows a modification of the subroutine indicated by the broken line block RESET shown in FIG. 7. In the case of the control process illustrated in FIG. 7, the sewing machine is inhibited from operation until the reset signal is applied even after the fault has been removed. To the contrary, the subroutine illustrated in FIG. 8 are so programmed that the operation of the sewing machine can be restored automatically immediately after the switches LSW and/or TSW have regained the normal state.

In the case of the embodiments described above, the protection control operation is realized on the basis of the fact that both of the leading switch LSW and the trailing switch TSW will not simultaneously be turned on in the normal conditions. Accordingly, the trailing switch TSW is constantly checked and, if that switch is detected in the on-state simultaneously with the on-state of the leading switch, the sewing machine is determined to be in the abnormal state, whereby the operation of the sewing machine is instantly stopped. However, the teachings of the invention can be realized in conjunction with the needle position detectors, as described below by referring to FIG. 9 which shows another embodiment of the protection apparatus according to the invention in which the erroneous operation is ascribable to the needle position detectors.

Figure 9:
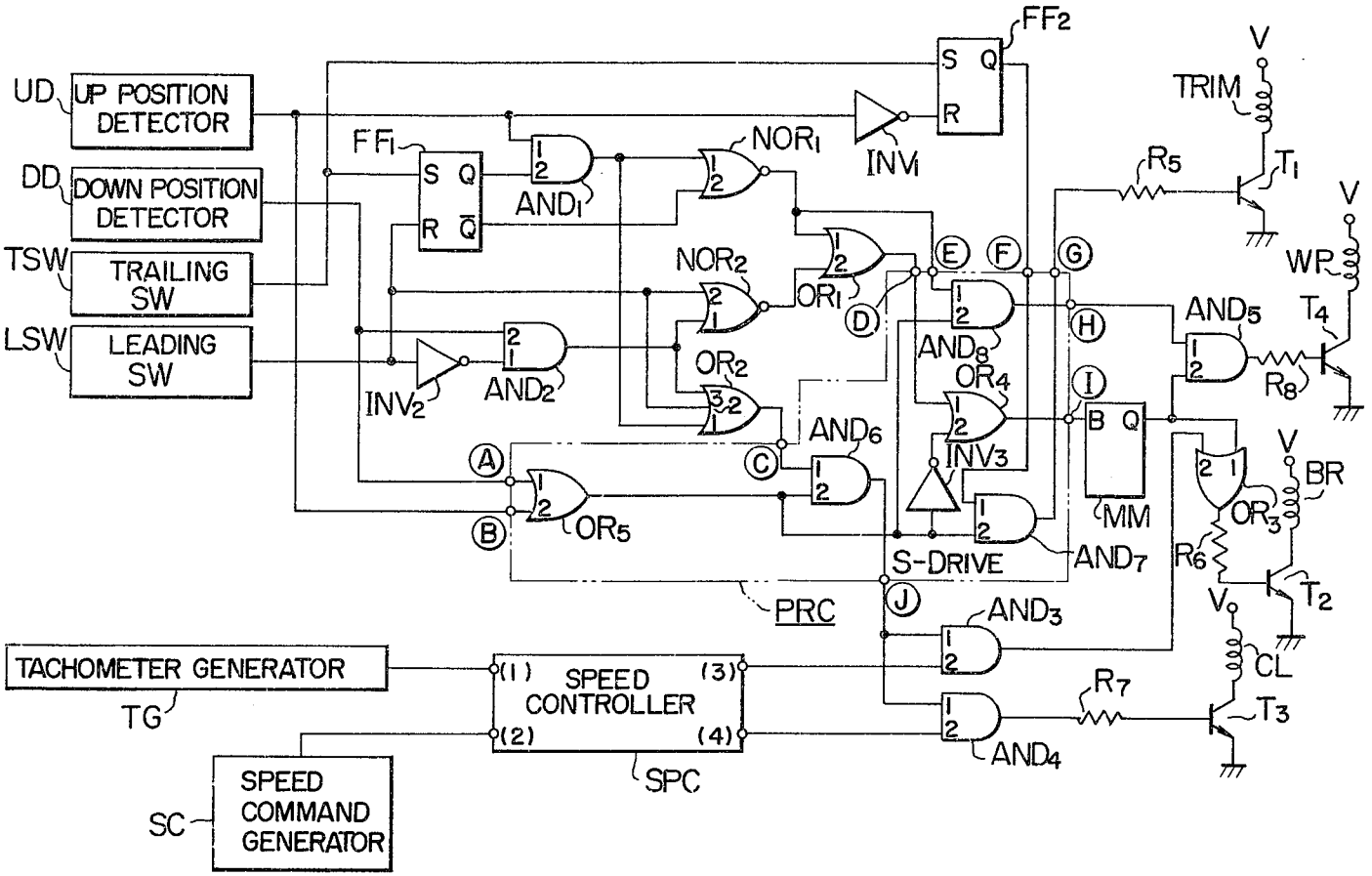
FIG. 9 is a circuit diagram showing another embodiment of the control circuit according to the invention.

In FIG. 9, reference symbols UD and DD denote an up position detector and a down position detector for the sewing needle which are adapted to produce a low level or L-level output at the upper needle position and the lower needle position, respectively. The leading switch LSW and the trailing switch TSW are interlocked with a foot pedal FP in such a manner that the switch LSW is turned on when the pedal FP is trodden down forwardly by the tiptoe, while the switch TSW is turned on by treading down the pedal FP backwardly by the heel of a foot. Each of these switches LSW and TSW will produce a high level or H-level output signal when they are turned on. In the neutral position of the foot pedal FP in which no tread or pressing force is applied, both of the switches LSW and TSW are in the off-state, corresponding to the low level L outputs therefrom.

A tachometer generator TG is connected to a first input (1) of a speed controller circuit SPC for controlling the operation speed of the sewing machine to be constant. To this end, the speed controller circuit SPC has two outputs (3) and (4) for controlling the brake coil BR and the clutch coil CL, respectively. The output signal (3) is applied to an input terminal 2 of an AND gate circuit $AND_3$, while the output (4) is applied to the input terminal 2 of AND gate circuit $AND_4$. The speed controller circuit SPC is supplied with another input signal from a speed command circuit having a similar function as the one described hereinbefore in conjunction with FIG. 3*b*.

The output signal from the up position detector UD is applied to a reset terminal R of a flip-flop $FF_2$ through an inverter circuit $INV_1$ and at the same time to an input 1 of an AND gate circuit $AND_1$. The output from the down position detector DD is coupled to an input 1 of an AND gate circuit $AND_2$. The output signal from the leading command switch LSW is coupled to a reset terminal R of a flip-flop $FF_1$, an input 2 of NOR gate circuit $NOR_2$, and an input 2 of an OR gate circuit $OR_2$, respectively, and additionally to an input 2 of an AND gate circuit $AND_2$ through an inverter $INV_2$. On the other hand, the output signal from the trailing command switch TSW is coupled to set terminals S of the flip-flops $FF_1$ and $FF_2$, respectively.

The flip-flop $FF_2$ has an output Q which is coupled to an input 1 of AND gate circuit $AND_7$ having a second input 2 connected to the input terminals 2 of AND gates $AND_6$ and $AND_8$ as well as to the input of an inverter circuit $INV_3$ and to the output terminal of OR gate circuit $OR_5$. The output of the inverter $INV_3$ is coupled to an input 2 of OR gate circuit $OR_4$.

The output of the AND gate circuit $AND_7$ is connected to the base of a transistor $T_1$ having a collector connected to one end of a coil TRIM of an automatic thread trimmer mechanism which coil has the other end connected to the potential source V. The Q-output of the flip-flop $FF_1$ is connected to an input 2 of AND gate circuit $AND_1$, while the complementary output $\overline{Q}$ thereof is connected to an input 2 of the NOR gate circuit $NOR_1$. The output of the AND gate circuit $AND_1$ is connected to an input 1 of the NOR gate circuit $NOR_1$ having an output connected to an input 1 of OR gate circuit $OR_1$ and to an input 1 of the AND gate circuit $AND_8$. The output of the OR gate circuit $OR_2$ is connected to an input 1 of the AND gate circuit $AND_6$ which has the output connected to the input terminals 1 of the AND gate circuits $AND_3$ and $AND_4$, respectively. The output of the NOR gate circuit $NOR_2$ is coupled to an input 2 of the OR gate circuit $OR_1$ which has the output connected to an input 1 of the OR gate circuit $OR_4$, the output of which in turn is connected to an input terminal B of a mono-stable multivibrator MM having an output terminal Q connected to an input 2 of AND gate circuit $AND_5$ and an input 1 of OR gate circuit $OR_3$. The latter has a second input 2 connected to the output of the AND gate circuit $AND_3$. The input terminal 1 of the AND gate circuit $AND_5$ is connected to the output of AND gate circuit $AND_8$, while the output of the former is connected to the base of a transistor $T_4$ through a resistor $R_8$. The output of OR gate circuit $OR_3$ is connected to the base of a transistor $T_2$ through a resistor $R_6$. The output of AND gate circuit $AND_4$ is connected to the base of a transistor $T_3$ through a resistor $R_7$. The transistors $T_4$, $T_3$ and $T_2$ have the respective collectors connected to the power source V through a thread wiper coil WP, the brake coil BR and the clutch coil CL, respectively.

With the arrangement described above, when the leading command switch LSW is turned on, the output of the OR gate circuit $OR_2$ will be at a high level H. At that time, if the down position detector DD and the up position detector UD produce no signals simultaneously, the output of the OR gate circuit $OR_5$ will be at the high level H and hence the output of the AND gate circuit $AND_6$ which is referred to as S-DRIVE signal will be at the high level H. Consequently, the outputs (3) and (4) of the speed controller circuit SPC will become validated, whereby the clutch coil CL as well as the broke coil BR are controlled by the output signals from the speed controller circuit SPC, thereby to maintain the operation speed of the sewing machine SM to be constant, at which speed the machine SM can continue to be driven.

On the other hand, if the down position detector DD is faulty and the output signal thereof remains at the low level L, then the L-level output from the up position detector UD representing the detection of the upper needle position will result in the low level output from the OR gate circuit $OR_5$. Consequently, outputs of the AND gate circuits $AND_6$, $AND_7$ and $AND_8$ will be at the low level L with the result that the outputs from the AND circuits $AND_4$ and $AND_5$ will be also at the low level L. Then, the transistors $T_1$, $T_3$ and $T_4$ will remain nonconductive. Under the circumstances, neither the clutch coil CL nor the automatic thread trimmer coil TRIM nor the thread wiper coil WP will be energized.

Additionally, since the output from the inverter $INV_3$ and hence the output from the OR gate circuit $OR_4$ will become the high level H, the mono-stable multivibrator MM will be triggered, whereby the brake coil BR is energized for a predetermined time determined by the mono-stable multivibrator MM to stop the operation of the sewing machine SM.

When the leading switch LSW is turned off during rotation of the sewing machine, the signal S-DRIVE which validates the speed controller circuit SPC will be cut off. However, if the output signal from the down position detector DD is absent at that time (i.e. at the high level H), the output from the AND gate circuit $AND_2$ will be at the high level H, resulting in the high level outputs also from the gate circuits $OR_2$ and $AND_6$. Thus, the signal S-DRIVE is at the high level H, whereby the sewing machine SM is operated. When the needle has reached the lower position after a corresponding revolution of the machine SM, the output from the down position detector DD will then become the low level L, as the result of which the output from the AND gate circuit $AND_2$ will be at the low level to invalidate the signal S-DRIVE. Simultaneously, since the output signal from NOR gate circuit $NOR_2$ together with the outputs from the OR gate circuits $OR_1$ and $OR_4$ will become the high level H, the mono-stable multivibrator MM is turned on for the predetermined time, thereby to energize the brake coil BR. Thus, the sewing machine SM is stopped with the needle ND located at the lower position.

When the trailing command switch LSW is turned on, the high level Q-output will be produced from the flip-flop $FF_2$, causing the output from the AND gate circuit $AND_7$ to be at the high level H. Thus, the automatic thread trimmer coil TRIM is energized. At the same time, since the Q-output from the flip-flop $FF_1$ will become the high level H, the outputs from the gates $AND_1$, $OR_2$ and $AND_6$ become the high level H, thereby to validate the speed controller circuit SPC. The sewing machine SM is then driven. After a half-revolution of the sewing machine SM, the needle will reach the upper position, which results in the low level L output from the up position detector UD to cause the output from the gate $AND_1$ as well as the outputs from gates $OR_2$ and $AND_6$ to be at the low level L. Consequently, the signal S-DRIVE is interrupted to stop the operation of the sewing machine SM. At the same time, since the output from $NOR_1$ is at the high level H with the outputs from the gates $OR_1$ and $OR_4$ taking also the high level H, the brake is actuated for the predetermined duration determined by the multivibrator MM to stop the machine SM at the position where the needle is located at the upper position. Simultaneously, the flip-flop $FF_2$ is reset with the Q-output thereof taking the low level L, whereby the automatic thread trimmer coil TRIM is deenergized. Additionally, output signals from the gate $AND_1$ and the flip-flop $FF_1$ become the low level L, resulting in the high level (H) outputs from the gate $NOR_1$ and $AND_8$. Thus, the thread wiper coil WP is energized in synchronism with the brake coil BR, thereby to remove or clear the trimmed thread.

Assuming that the up position detector is faulty and the output therefrom remains at the low level L, the L-level output signal from the low position detector DD will instantaneously cause the output from the gate $OR_5$ to be at the low level L, thereby to disenable the AND gates $AND_6$, $AND_7$ and $AND_8$ with the output from the gate $OR_4$ taking the high level H. Consequently, all of the automatic thread trimmer coil TRIM, the thread wiper coil WP and the clutch coil CL are inhibited from energization, while the brake coil BR is energized for the predetermined thereby to stop the sewing machine SM in a fool-proof manner. Thus, there will never arise any dangers such as brake of the needle.

The above description has been made in conjunction with the case in which the up or down position detector UD or DD is faulty. However, the safety operation control described above will be effective in the case where the fault is caused for other reasons such as short-circuit of electric lead wires, noise or the like.

It will be thus appreciated that the protection apparatus according to the invention can safely exclude the erroneous operation of the sewing machine which otherwise may occur due to failure of the up and down position detectors UD and DD for detecting the upper and the lower positions of the sewing needle, short-circuit, noise or the like causes, and protects the user from danger such as break of the needle.

The main feature of the present invention is realized particularly in the protection circuit PRC indicated by a broken line block in FIG. 9. Another embodiment of such protection circuit PRC will be described by referring to FIG. 10, in which circuit arrangements connected to the points Ⓐ to Ⓙ are same as those shown in FIG. 9 and thus omitted from illustration.

In the case of the protection circuit shown in FIG. 9, the circuit arrangement is made such that the apparatus is restored to the normal state immediately after the fault of the up or down position detector UD or DD is removed. In the protection circuit shown in FIG. 10, alarm means are provided for signalling the user of a fault or abnormality in combination with manual operation restoring means for inhibiting the instantaneous automatic initiation of operation of the sewing machine, when the cause of fault has been removed, thereby to protect safely the operator or user.

Figure 10:
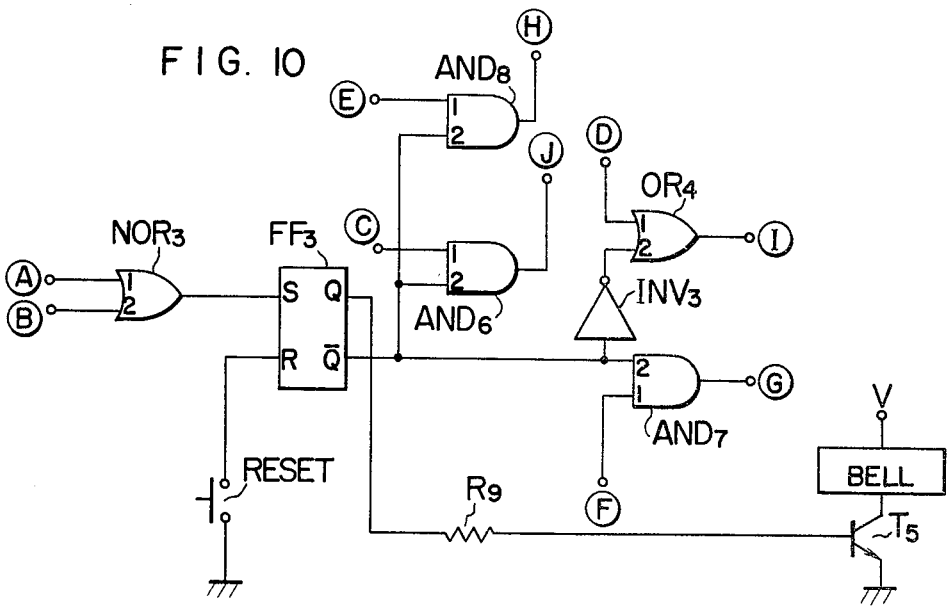
FIG. 10 is a circuit diagram showing a modification of the control circuit of FIG. 9.

Referring to FIG. 10, when the up and the down position detectors UD and DD produce the signals simultaneously, the output from the gate $NOR_3$ will become a high level H, whereby the flip-flop $FF_3$ is set to maintain the $\overline{Q}$-output at a low level L. Consequently, output signals from the gates $AND_6$, $AND_7$ and $AND_8$ will remain at the low level L, resulting in that the coils for the automatic thread trimmer, the thread wiper and the clutch remain in the deenergized state. At the same time, because of the high level Q output from the flip-flop $FF_3$, the transistor $T_5$ is turned on, thereby to actuate an alarm device BELL for signalling the prevailing abnormal states.

The restoration of the machine operation is effected by applying a reset signal to the reset terminal R of the flip-flop $FF_3$ by pushing a reset button switch RESET or through any suitable means.

Figure 11:
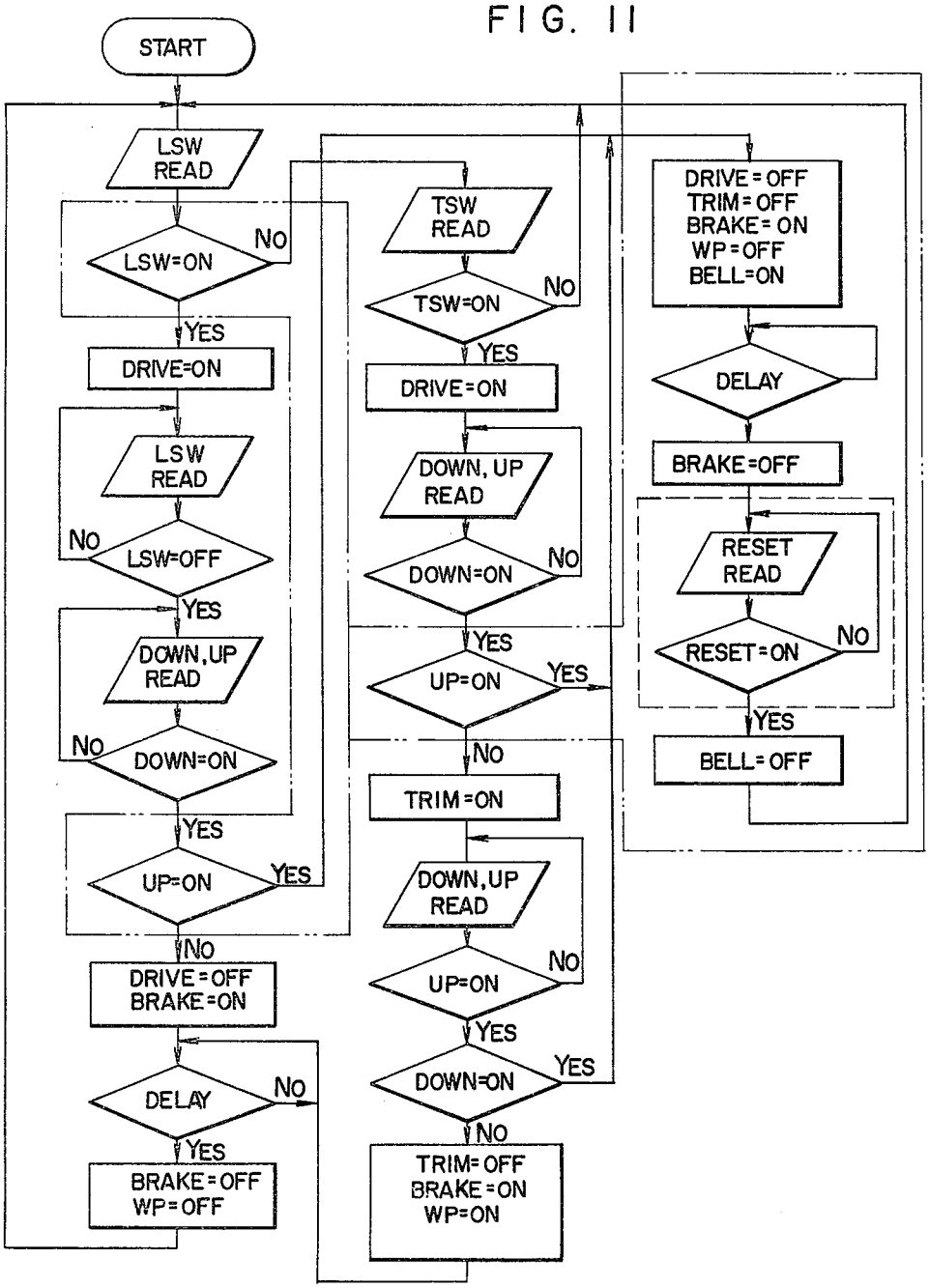
FIG. 11 is a flow chart illustrating operation of the control circuit of FIG. 9.

FIG. 11 is a flow chart for illustrating operation of the protection apparatus according to still another embodiment in which a micro-computer is employed for the control unit in the apparatus shown in FIG. 10.

It is first assumed that both of the up and the down position detectors UD and DD are in the normal state. The micro-computer MC is initialized at the block START. At the block LSW READ, the state of the switch LSW is fetched as the input information. At the succeeding decision block LSW=ON, the state information of the switch LSW is checked, and if the switch LSW is "on", the signal DRIVE is produced to validate the speed control signal, thereby to drive the sewing machine SM.

At the next step LSW READ, the state information of the switch LSW is again fetched as the input and checked when the switch LSW is turned off at the decision block LSW=OFF. If the result becomes negative, i.e. the switch LSW is turned off, the program proceeds to the block DOWN, UP READ where the output signal from the down position detector DD is fetched in the computer in order to check that the needle reaches the lower position at the decision block DOWN=ON. This subroutine is repeated until the needle has reached the lower position, upon which the signal S-DRIVE is interrupted and the signal S-BRAKE is generated at the block DRIVE=OFF & BRAKE ON, when no upper position signal is produced. After the elapse of the braking duration as decided at the block DELAY, the signal S-BRAKE is cleared. Then, the program routine returns to the first block LSW READ to check the state of the switch LSW.

When the switch TSW is turned on with the switch LSW being off, the state information of the switch TSW is fetched at the block TSW READ and checked at the decision block TSW=ON. At this time, the switch TSW is closed, the decision is affirmative and thus the signal DRIVE is produced at the step DRIVE=ON to drive the sewing machine. The next step is to check the lower position of the needle at the block DOWN, UP READ. If the needle is detected as located at the lower position, the result of the decision block DOWN=ON is affirmative, as the result of which the automatic thread trimming signal TRIM is validated at the block TRIM=ON after having confirmed that no upper position signal is present. Again, the upper position is checked at the step DOWN, UP READ. When the needle has reached the upper position after a half revolution of the sewing machine, the decision at the block UP=ON will be affirmative and the automatic thread trimming signal S-TRIM is cleared, while the brake signal S-BRAKE as well as the thread wiper signal S-WP are made valid.

After the elapse of a preset time interval, the signals S-BRAKE and S-WP are made invalid. The program returns to the first block to check the switch LSW.

Next, it is assumed that the down position detector DD is faulty and remains continuously in the on-state. Then, the result at the decision block DOWN=ON is affirmative. When the upper position is fetched at the block DOWN, UP READ and the result of the decision block UP=ON is affirmative, the signals DRIVE, TRIM and WP are made invalid, while the signals BRAKE and ALARM are produced. The signal BRAKE is made invalid after elapse of a preset time duration. This state is held as it is until the reset signal has been applied at the step RESET.

In this manner, the protection circuit shown in FIG. 11 will operate so as to assure a safety operation by excluding danger such as break of needle due to the fault of the down position detector, short circuit, noise or the like in the quite similar manner as the circuits shown in FIGS. 8 and 10.

Figure 12:
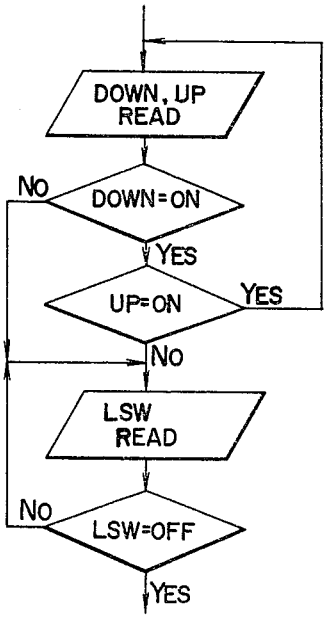
FIG. 12 is a flow chart illustrating a modification of the program executed by the micro-computer employed in the control circuit of FIG. 9.

FIG. 12 shows a modification of the subroutine indicated by the broken line block RESET. In the case of the control process illustrated in FIG. 11, the sewing machine is inhibited from operation until the reset signal is applied even after the fault has been removed. To the contrary, the subroutine illustrated in FIG. 12 is so programmed that the operation of the sewing machine can be restored automatically immediately after the switches LSW and/or TSW have regained the normal state.

In the foregoing, description has been made based on a sewing machine of an electromagnetic clutch type. However, it will be appreciated that the invention can be equally implemented in a sewing machine connected to a DC motor the speed of which is controlled. In this case, the clutch signal is utilized as the speed control signal for the DC motor.

As will be appreciated from the foregoing description, the invention has now provided a protection apparatus for an electric motor-driven sewing machine which is capable of positively preventing dangers such as breakage of the needle and erroneous operations which may be brought about due to faults of the command switches and up and down needle position detectors as well as breakage of the lead wires, short-circuit, noise or the like, thereby to assure a safe and reliable operation of the sewing machine.

We claim:

1. A protection apparatus for safety operation of an electric motor-driven sewing machine, comprising: drive mechanisms for driving said sewing machine by an electric motor; a thread trimmer mechanism for automatically trimming a thread; a thread wiper mechanism removing thread as trimmed by said thread trimmer mechanism, means for supplying predetermined command signals; means for detecting selected positions of a needle of said sewing machine; control circuit means for controlling said various mechanisms in accordance with the corresponding detected signals and control signals; abnormality detecting means for detecting an abnormal state in which two of said signals, which are not to take place simultaneously during normal operation, occur simultaneously and for generating an output abnormality signal in response thereto; and means for responding to the output abnormality signal from abnormality detecting means thereby to invalidate operations of at least said drive mechanism, said automatic thread trimmer mechanism and said thread wiper mechanism and to actuate a stoping mechanism to stop the operation of said sewing machine.

2. A protection apparatus as set forth in claim 1, wherein said abnormality detecting means is adapted to detect simultaneous generation of both a forward tread signal constituting a command signal for driving said sewing machine and a backward tread signal constituting a command for the automatic thread trimming operation, both of said tread signals being produced by foot pedal switches for producing at least some of said predetermined command signals.

3. A protection apparatus as set forth in claim 1, further comprising a mechanism for stopping the operation of the sewing machine immediately after said abnormal state is detected by said abnormality detecting means thereby to invalidate operation of said thread wiper mechanism, wherein said sewing machine stopping mechanism is adapted to maintain the stopped state of said sewing machine for a predetermined time.

4. A protection apparatus as set forth in claim 1, wherein, in response to detection of the abnormal state, operation of the drive mechanism of said sewing machine is made invalid and at the same time an alarm device is actuated.

5. A protection apparatus as set forth in claim 1, the restoration of the operation of said sewing machine is adapted to be accomplished by an externally applied reset signal.

6. A protection apparatus as set forth in claim 1, wherein of the two signals detected by said abnormality detecting means, one is produced by an up position detector for detecting an upper position of the sewing needle, while the other signal is produced by a down position detector for detecting a lower position of the sewing needle.

7. A protection apparatus as set forth in claim 1, wherein said means for invalidating operation of said drive mechanism thereby to stop the operation of said sewing machine in response to the detection of abnormality is provided with alarm generating means.

* * * * *